US005794902A

United States Patent [19]

Henry et al.

[11] Patent Number: 5,794,902

[45] Date of Patent: Aug. 18, 1998

[54] SHELF BRACKET FOR USE WITH A GROOVED SHELF

[75] Inventors: Eric F. Henry, Rutherford; Jonathan D. Lewis, Martinsville, both of N.J.

[73] Assignee: HMG Worldwide In-Store Marketing, Inc., New York, N.Y.

[21] Appl. No.: 779,166

[22] Filed: Jan. 6, 1997

[51] Int. Cl.[6] ..... A47G 29/02

[52] U.S. Cl. ..... 248/250; 248/243; 211/90.01

[58] Field of Search ..... 248/250, 245, 248/241, 243, 22.1; 211/90.01, 192, 193, 134, 153; 108/152, 27, 28; 312/126

[56] References Cited

U.S. PATENT DOCUMENTS

| | | | |
|---|---|---|---|
| 4,429,850 | 2/1984 | Weber et al. | 248/250 |
| 4,614,273 | 9/1986 | Ishii | 211/183 |
| 4,736,919 | 4/1988 | Bessinger | 248/250 |
| 5,201,120 | 4/1993 | Patrick | 248/250 X |
| 5,456,435 | 10/1995 | Sweeney | 248/250 |
| 5,509,634 | 4/1996 | Gebka et al. | 248/250 X |
| 5,575,444 | 11/1996 | Otema | 248/250 X |

*Primary Examiner*—Alvin C. Chin-Shue
*Assistant Examiner*—Long Dinh Phan
*Attorney, Agent, or Firm*—Cohen, Pontani Lieberman, Pavane

[57] ABSTRACT

A bracket assembly for mounting a shelf having a grooved surface to a supporting structure. The bracket assembly includes a frame having a support portion which defines a slot for receiving an edge of the shelf. The frame includes at least one attachment leg for securing the frame to the supporting structure. A base plate mountable to the support portion of the frame is provided and includes a hook which seats within the groove when the shelf is inserted in the slot. An arm moveable between a first position and a second position is connected to the hook for releasing the hook from the groove when the arm is urged to the second position.

12 Claims, 3 Drawing Sheets

SHELF BRACKET FOR USE WITH A GROOVED SHELF

BACKGROUND OF THE INVENTION

I. Field of the Invention

The present invention relates to brackets for mounting shelves to a supporting structure. More particularly, the present invention pertains to a bracket for use with a shelf having a grooved surface.

II. Description of the Related Art

Many forms of brackets for shelf assemblies are known. However, many prior art devices are too costly or complex, or difficult to use. Also, the prior art devices are generally adapted to be used with only one type of mounting surface so that the user must first determine which type of bracket can be employed in a given location or surface before purchasing the necessary hardware. Additionally, among prior art devices there is no satisfactory solution for attaching a shelf to a bracket in a manner to resist unintended displacement while, at the same time, allowing easy removal of the shelf from the bracket.

Commonly owned U.S. Pat. No. 5,456,435 discloses an improved shelf bracket comprising a metal frame for support, a locking bracket having a hook assembly for engagement with a groove in the shelf for securing the shelf in place, and a cam which serves as an actuating arm for forcing the shelf away from the hook assembly to allow the shelf to be disengaged from the bracket. The rear wall of the bracket is provided with connectors which allow the bracket to be affixed to a variety of supporting structures. While this is an improvement over prior art shelf bracket arrangements, there is still a need for a simpler shelf bracket that is more economical to manufacture, more efficient to use and adaptable to a wide variety of supporting structures without the need for additional hardware.

Accordingly, it is an object of the present invention to provide a highly simplified and economical shelf bracket apparatus which is easy to engage and disengage from a supporting structure and which has the ability to hold a shelf having a grooved surface firmly in place while the shelf is in an engaged position, without any tendency for accidental or premature separation of the shelf from the bracket.

Another object of the present invention is to provide a bracket capable of mounting a shelf onto a variety of supporting structures.

It is a further object of the present invention to provide a shelf bracket which enables more efficient use of the display space of a supporting structure and which has minimal intrusion into the space between the shelves, thus maximizing storage or display area and providing an uncluttered appearance.

SUMMARY OF THE INVENTION

The foregoing objectives have been met by the shelf bracket of the present invention which includes a simple frame formed from metal rods or the like. The frame has a slot for accepting and supporting an edge of a shelf, and has two attachment legs specifically deigned for engaging with a wide variety of supporting structures. The bracket has a securing mechanism which is attached to the bottom of the frame and which is engageable with a groove in the surface of the shelf for securing the shelf against accidental disengagement. The hook means includes a push tab or arm which allows disengagement of the shelf from the bracket by exerting force on the arm, thereby drawing the securing mechanism away from the groove and permitting the shelf to be separated therefrom.

The simplicity of the present invention provides for a cost-effective mechanism, as opposed to existing designs, as well as a compact design for minimizing intrusion of the display or storage space, thus preventing an uncluttered appearance and allowing a more efficient use of the storage or display space.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
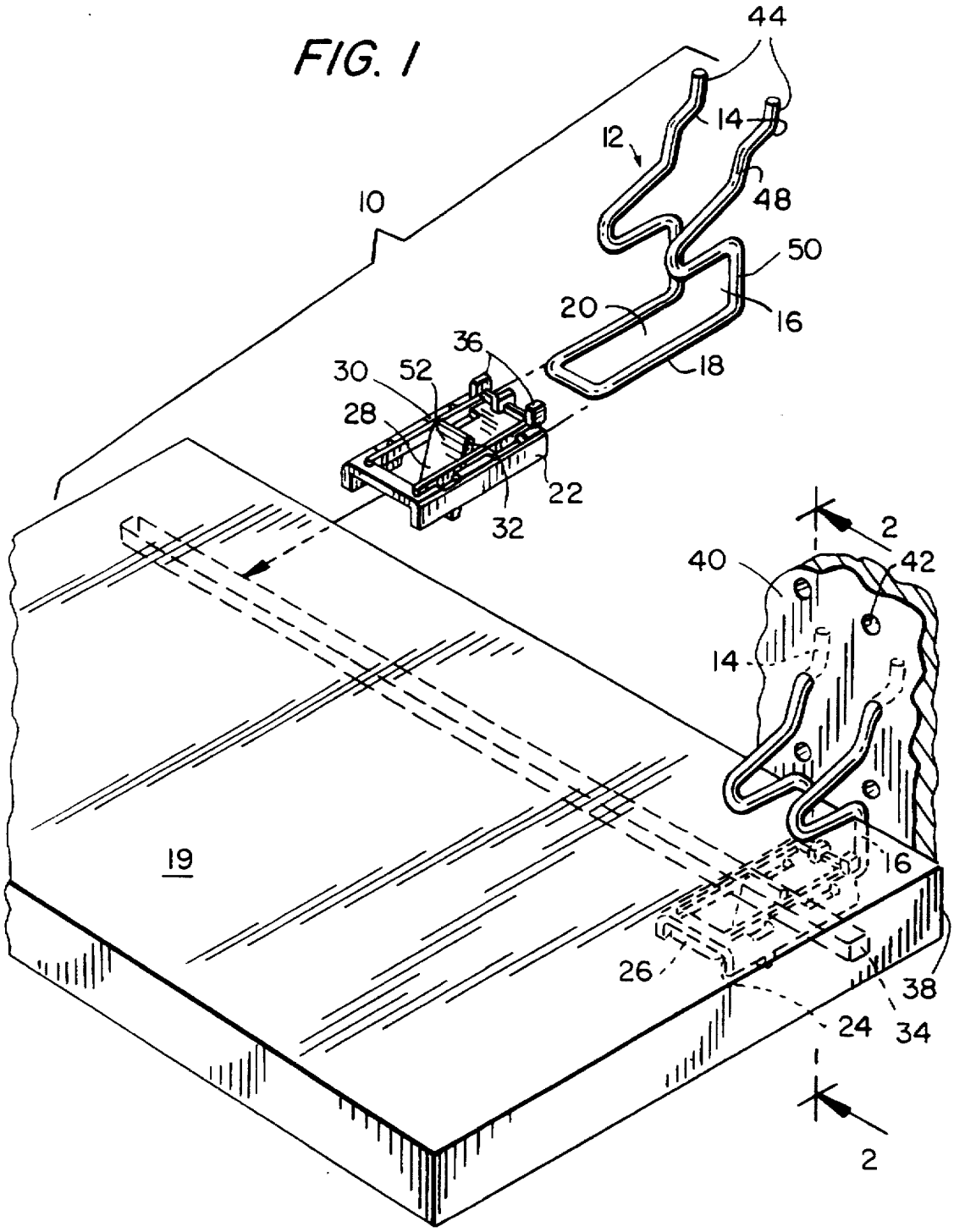
FIG. 1 is a perspective view of the present invention depicting a first bracket assembly (partially show in phantom), engaged with a shelf and a supporting structure, and an exploded view of a second bracket displaced from the shelf and supporting structure.

Referring now to the drawings and initially to FIG. 1, a bracket assembly 10 is there depicted. As shown, the bracket assembly includes a frame 12 formed from a rod-shaped element which is preferably constructed from a durable material such as metal or plastic. The frame 12, which may be formed by molding or bending the rod-shaped material, includes a pair of legs 14, a C-shaped slot 16 and a support portion 18 for accepting and supporting a shelf 19. The support portion 18 defines a substantially horizontal plane having an upper surface 20. When the shelf is inserted into the C-shaped slot 16 as contemplated by the present invention, the shelf extends outwardly from the bracket assembly 10 in a cantilevered manner as shown in FIG. 1.

Figure 3:
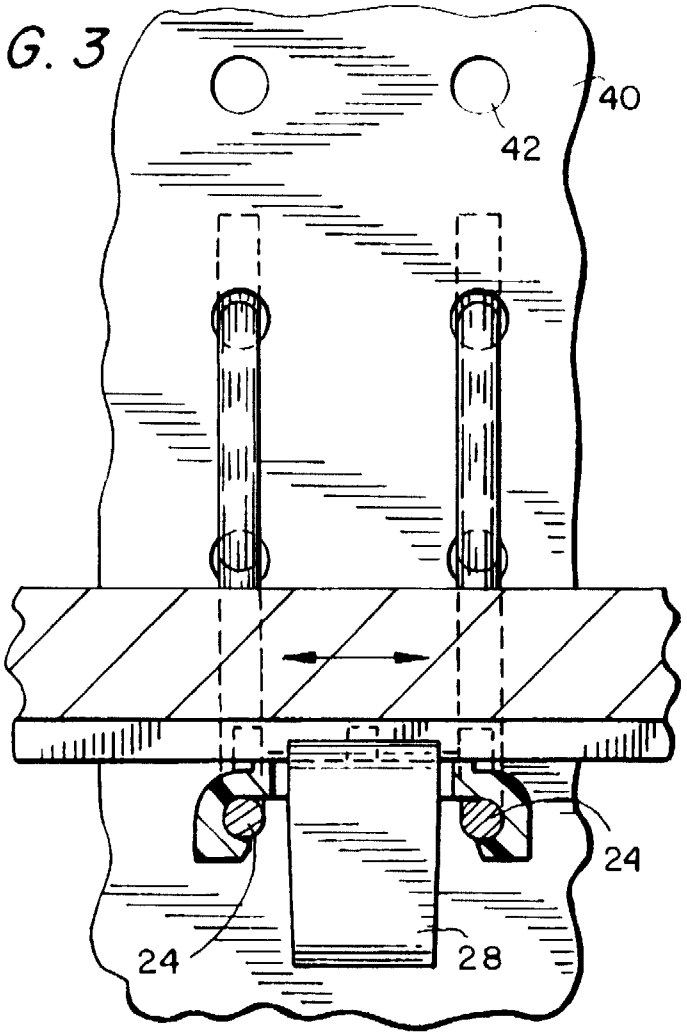
FIG. 3 is a view taken substantially through the plane 3—3 in FIG. 2.
Figure 2:
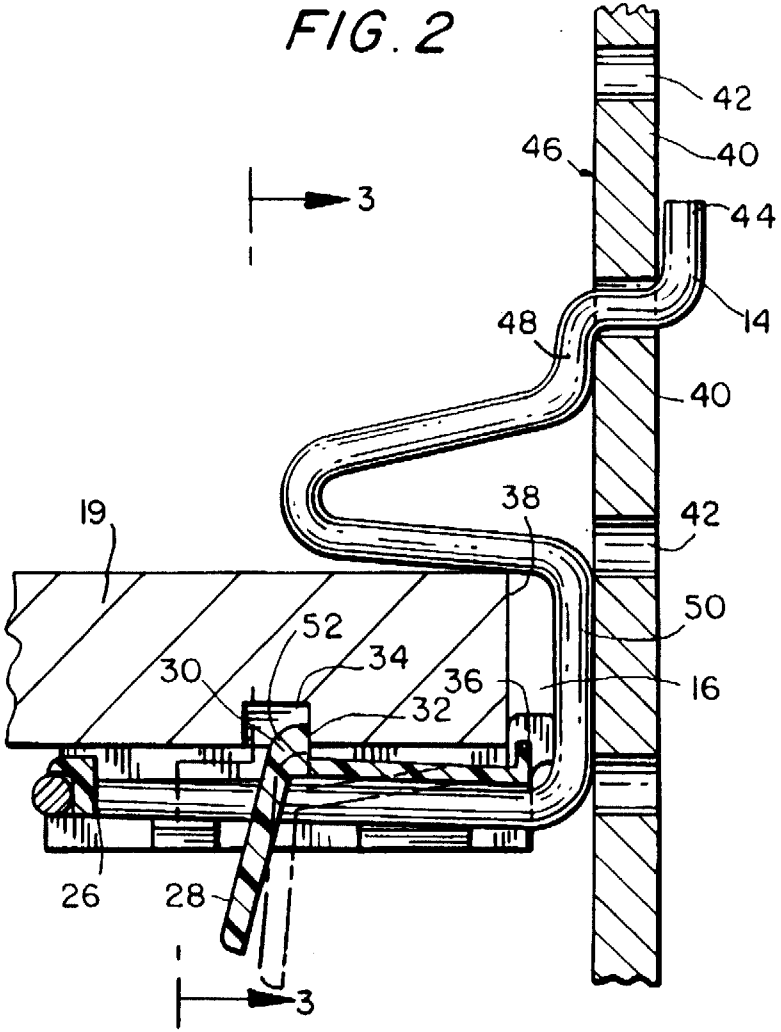
FIG. 2 is a view taken substantially through the plane 2—2 in FIG. 1.

With reference now to FIGS. 1–3, a base plate 22 is secured to the support portion 18 of frame 12 by mounting hooks 24—dimensioned for snugly fitting about support portion 18 of frame 12—and by a tab 26 which abuts the front of support portion 18 for preventing the base plate 22 from sliding off of frame 12. In the preferred embodiment, base plate 22 is constructed of a molded and durable plastic material.

Base plate 22 has a downwardly extending arm or lever 28 joined at a shoulder 30 to the base plate 22. As shown, arm 28 is angularly offset from the horizontal plane 20 and contains a securing mechanism 32 for engaging with a groove 34 formed in the underside of shelf 19. The securing mechanism 32 is preferably a hook which is integrally formed with the base plate 22 and which allows for removal of the shelf 19 from the securing mechanism 32 by pressing on arm 28 as more fully described below.

A plurality of tabs 36 is positioned at a predetermined distance from the securing hook 32; the distance being substantially equal to the distance between the groove 34 and the back edge 38 of the shelf 19, so that when the base plate 22 is connected to the shelf in a manner contemplated by the present invention, the shelf rests snugly against the tabs 36 and is secured by the securing hook 32, thus preventing movement of the shelf relative to base plate 22.

As explained above, shelf 19 is removed from the base plate 22 and, likewise, from the frame 12, by engaging arm 28. Specifically, and as best shown in FIG. 2, arm 28 forms a depending push tab. When no force is applied thereto, arm 28 remains stationary in a first position (shown in sold lines in FIG. 2) wherein the securing mechanism, e.g. hook 32, is biased to a first position wherein it is secured within groove 34. When a force is applied, arm 28 is moved to a second position which causes hook 32 to move to a second position downwardly away from the shelf 19, thereby causing the hook 32 to temporarily disengage with the groove 34 in the shelf 19. With the hook 32 disengaged, the shelf may be pulled forward so that it is removed from the bracket assembly 10.

To mount the bracket assembly 10 to a supporting structure, such as peg-wall 40, the legs 14 of frame 12 are oriented both rearwardly and upwardly away from the shelf 19. The rod-like material from which frame 12 is formed is dimensioned for snugly mating with a variety of mounting surfaces having spaced openings therein, such as peg-wall, slat-wall, uniweb and wire-grid, and the spacings between legs 14 are, likewise, dimensioned for this purpose. In FIGS. 1–3, the bracket assembly 10 is shown engaged with peg-wall 40 having spaced receiving cavities 42 in which the ends of legs 14 are disposed. It will be readily appreciated by those having ordinary skill in the art that various mounting techniques can be used to affix the frame 12 to a supporting structure and such various mounting techniques are intended to fall within the scope of this invention.

With additional reference to FIG. 2, each attachment leg 14 contains an upwardly extending end 44 and a substantially right-angle bent portion 48. When frame 12 is connected to wall 40 such as by inserting ends 44 through the holes 42, the upwardly extending ends 44 engage the back of the supporting structure 40 (which, as shown, may be the back face of the peg-wall 40), and the right-angle bent portions 48—which are parallel to and in lateral engagement with mounting surface 46—apply a force against the front face of the peg-wall 40 to partially support the weight of the shelf 19. Additionally, the rear portion of the C-shaped slot 16 (shown as frame portion 50) is also in lateral engagement with the supporting structure 40 to support the remainder of the shelf weight. The unique design of attachment legs 14 in cooperation with base plate 22 allow the bracket assembly 10 to be used with a wide variety of supporting structures without the need for additional attachment or mounting accessories.

Typically, multiple bracket assemblies 10 are used to support a shelf, such as by placing an assembly 10 near each end of the shelf in a width-wise direction as shown in FIG. 1. After positioning the bracket assemblies, the shelf may be inserted into the C-shaped slots 16 and thereby locked in place. To further assist in sliding the shelf into proper position, the front edge of the hook 32 in the preferred embodiment contains a curved or rounded edge 52 (FIG. 2). As can be appreciated, when the shelf edge 38 enters the slot 16 and engages the curved edge 52, the arm 28 is urged to its second position until the groove 34 is in place, at which point the spring force moves arm 28 back to its first position, thereby locking the shelf 19 in place. As set forth above, when removal of the shelf is required, the arm 28 is manually engaged for moving to the second position, thus disconnecting the hook 32 from the groove 34 and allowing shelf 19 to be removed therefrom.

Figure 4:
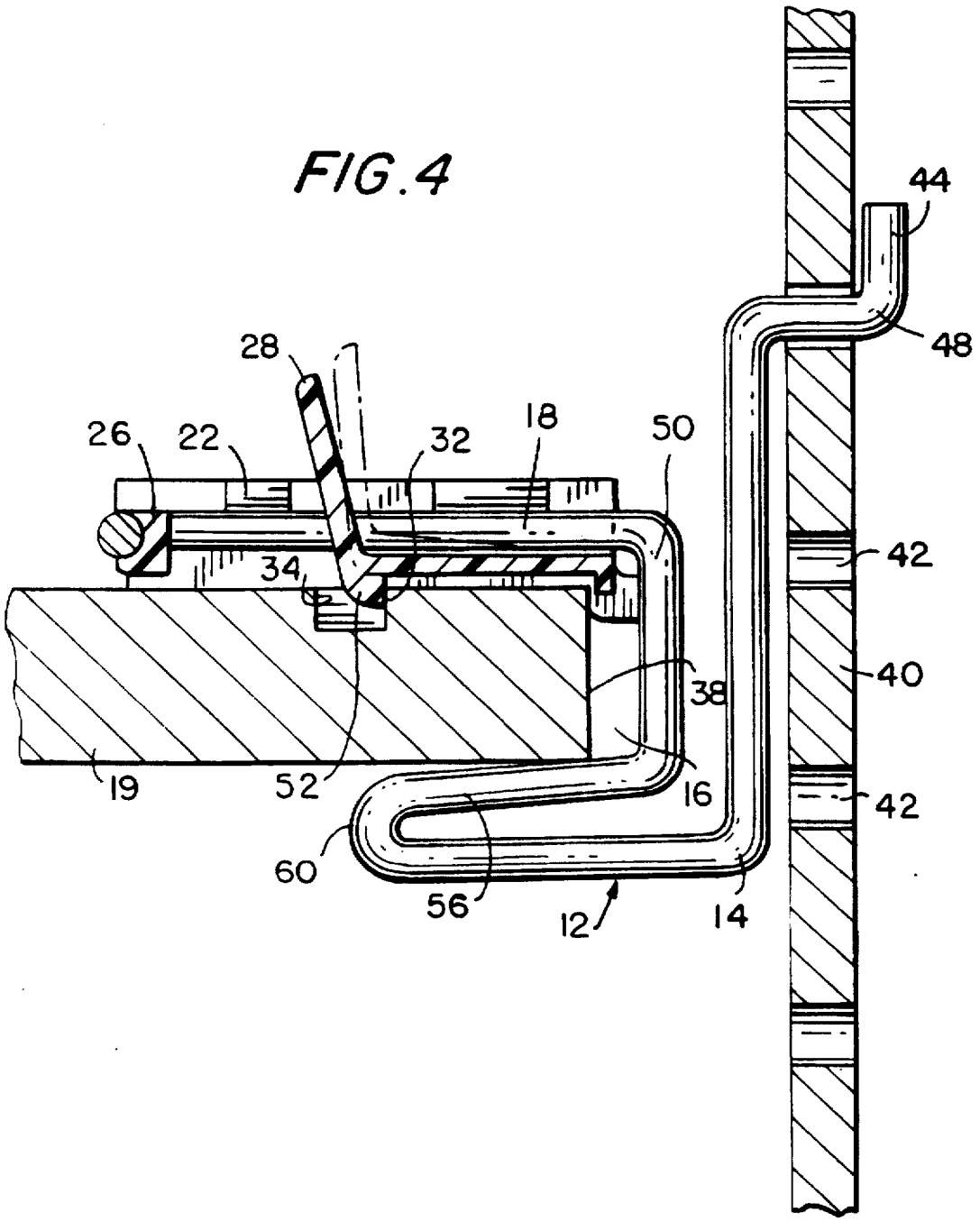
FIG. 4 is an alternative embodiment of the present invention.

With reference now to FIG. 4, and alternate embodiment of the present invention is there depicted. As shown, instead of the shelf 19 containing a groove on the bottom surface so that the hook 32 extends upward for seating within the groove, the bracket assembly 10 can be easily configured to support a shelf having a groove in its upper surface. In such an embodiment, the shelf 19 is supported between a lower support portion or leg 56 of the C-shaped slot 16 and the upper support portion 18. The base plate 22 serves as a top plate and is connected in a manner set forth above to the support portion 18, and arm 28 is shown extending upward (as opposed to downward in FIG. 2) so that the hook 32 is disposed within the groove 34. In the alternate embodiment of FIG. 4, the frame 12 is reconfigured so that legs 14 are bent at location 60 and extend upward in the same direction as arm 28, as opposed to an opposite direction of arm 28 as depicted in FIG. 2. As will be appreciated, this alternative embodiment will, likewise, support a shelf 19 and provide for easy disengagement from the bracket assembly by moving arm 28 to its second position for disengaging hook 32 from the groove 34.

As should by now be appreciated, the inventive bracket assembly allows for relatively effortless adjustment and removal of shelves contained in a display case or storage assembly. Moreover, the configuration of the inventive bracket assembly is such that it occupies minimal surface area of the shelves connected thereto while still providing access to the arm 28 for detaching the shelves when desired.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

We claim:

1. A bracket assembly for mounting a shelf having a groove formed therein to a supporting structure, said bracket assembly comprising:

a frame defining a slot for receiving an edge of the shelf, said frame having a substantially horizontal support portion having an upper surface defining the bottom of said slot, and an attachment leg having a first end connected to said support portion and a second end configured for engagement with the supporting structure for attaching said frame to the supporting structure; and a base plate releasably mountable to said support portion, said base plate having an upwardly extending hook for engagement with the groove in the shelf when the edge of the shelf is received in said slot on said base plate, and an arm connected to said hook and extending downwardly from said base plate below said support portion of said frame, said arm being biased to a first position in which said hook is in said groove when the shelf is in said slot and moveable to a second position when said hook is disengaged from the groove so that the shelf can be removed from said frame.

2. The bracket assembly of claim 1, wherein said slot has a mouth portion and wherein said upwardly extending hook further comprises a curved front edge positioned at the mouth portion of said slot for facilitating insertion of the edge of the shelf in said slot.

3. The bracket assembly of claim 1, wherein said base plate further comprises a securing tab for engaging said support portion to secure said base plate to said support portion.

4. The bracket assembly of claim 1, wherein said attachment leg further comprises a first and a second attachment leg.

5. The bracket assembly of claim 2, wherein said slot contains a back portion and wherein said base plate further comprises a rear tab positioned proximate the back portion of said slot for defining a predetermined distance between said hook and said rear tab, said predetermined distance being substantially equal to a distance between the groove in the shelf and the edge of the shelf so that, when said hook is positioned within the groove, said rear tab is proximate the shelf edge.

6. The bracket assembly of claim 2, wherein said rear tab further comprises a plurality of rear tabs.

7. A bracket assembly for mounting a shelf having a groove formed therein to a supporting structure, said bracket assembly comprising:

a frame defining a slot for receiving an edge of the shelf, said frame having an upper substantially horizontal support portion having a lower surface defining the top of said slot and a lower substantially support portion having an upper surface defining the bottom of said slot, and an attachment leg having a first end connected to said upper support portion and a second end configured for engagement with the supporting structure for attaching said frame to the supporting structure; and a top plate releasably mountable to said upper support portion, said top plate having a downwardly extending hook for engagement with the groove in the shelf when the edge of the shelf is received in said slot on said base plate, and an arm connected to said hook and extending upwardly from said base plate below said support portion of said frame, said arm being biased to a first position in which said hook is in said groove when the shelf is in said slot and moveable to a second position when said hook is disengaged from the groove so that the shelf can be removed from said frame.

8. The bracket assembly of claim 7, wherein said slot has a mouth portion and wherein said upwardly extending hook further comprises a curved front edge positioned at the mouth portion of said slot for facilitating insertion of the edge of the shelf in said slot.

9. The bracket assembly of claim 7, wherein said base plate further comprises a securing tab for engaging said support portion to secure said base plate to said support portion.

10. The bracket assembly of claim 7, wherein said attachment leg further comprises a first and a second attachment leg.

11. The bracket assembly of claim 8, wherein said slot contains a back portion and wherein said base plate further comprises a rear tab positioned proximate the back portion of said slot for defining a predetermined distance between said hook and said rear tab, said predetermined distance being substantially equal to a distance between the groove in the shelf and the edge of the shelf so that, when said hook is positioned within the groove, said rear tab is proximate the shelf edge.

12. The bracket assembly of claim 8, wherein said rear tab further comprises a plurality of rear tabs.

* * * * *